US012163765B2

(12) United States Patent
Gore

(10) Patent No.: US 12,163,765 B2
(45) Date of Patent: Dec. 10, 2024

(54) SPARK IGNITION FLAMETHROWER

(71) Applicant: Roughrider Arms LLC, Grand Forks, ND (US)

(72) Inventor: Josh Gore, McHenry, IL (US)

(73) Assignee: Roughrider Arms LLC, Grand Forks, ND (US)

( * ) Notice: Subject to any disclaimer, the term of this patent is extended or adjusted under 35 U.S.C. 154(b) by 0 days.

(21) Appl. No.: 17/163,350

(22) Filed: Jan. 30, 2021

(65) Prior Publication Data

US 2021/0318104 A1 Oct. 14, 2021

Related U.S. Application Data

(60) Provisional application No. 62/969,023, filed on Feb. 1, 2020.

(51) Int. Cl.
*F41H 9/02* (2006.01)

(52) U.S. Cl.
CPC ..... *F41H 9/02* (2013.01)

(58) Field of Classification Search
CPC . F41H 9/02; F23D 14/28; F23D 14/38; F23D 14/465
USPC ..... 431/91, 345, 343, 344, 128, 248, 264
See application file for complete search history.

(56) References Cited

U.S. PATENT DOCUMENTS 1,459,658 A * 6/1923 Eggers ..... F23D 91/02 431/247
2,331,388 A * 10/1943 Graham ..... F41H 9/02 431/91
2,363,168 A * 11/1944 Findley ..... F24H 9/2085 126/93
2,666,480 A * 1/1954 Peterson ..... F23D 91/02 431/255
3,011,541 A * 12/1961 Sorensen ..... F41H 9/02 102/293
5,409,370 A * 4/1995 Henderson ..... F23D 5/16 126/96
5,586,688 A * 12/1996 Johnson ..... F41B 9/0021 200/82 R
5,730,325 A * 3/1998 Cheung ..... F41B 9/0037 222/255

(Continued)

FOREIGN PATENT DOCUMENTS

CH 216441 A * 8/1941
CN 207542674 U * 6/2018

(Continued)

*Primary Examiner* — Jorge A Pereiro
*Assistant Examiner* — Logan P Jones
(74) *Attorney, Agent, or Firm* — Weisberg I.P. Law, P.A.

(57) ABSTRACT

The Spark Ignition Flamethrower may include a plastic or composite housing, a heat shield, fuel manifold, fuel pump, fuel nozzle, electrode, high voltage coil, and control module. The Spark Ignition Flamethrower ignites a fuel using a spark generated by the electrodes without the need for an initial flame. The electrodes may be supplied with high enough voltage to generate a plasma which results in an increased conductive area that increases the efficiency of lighting the fuel. The Spark Ignition Flamethrower may also be oriented in multiple configurations due to the adaptable fuel manifold which is capable of receiving fuel from various fuel sources.

15 Claims, 7 Drawing Sheets

(56) References Cited

U.S. PATENT DOCUMENTS 5,857,262 A * 1/1999 Bonnema ..... F24H 3/0488 431/344
5,902,100 A * 5/1999 Long ..... F23Q 9/08 431/255
6,257,875 B1 * 7/2001 Johnstone ..... F23D 14/28 431/248
6,561,792 B1 * 5/2003 Pfund ..... F23Q 3/006 431/264
7,624,898 B2 * 12/2009 Hornsby ..... B05B 9/0861 222/383.2
8,590,285 B2 * 11/2013 Hohmann ..... F23Q 3/008 248/226.12
2007/0290591 A1 * 12/2007 Lykowski ..... C22C 19/058 420/443
2008/0274434 A1 * 11/2008 Burdsall ..... F23D 14/465 215/44
2010/0213209 A1 * 8/2010 Todokoro ..... F41B 9/0018 222/79
2011/0217662 A1 * 9/2011 Zagoroff ..... F23Q 3/002 431/264
2013/0199508 A1 * 8/2013 Toedter ..... F02P 5/1502 123/594
2014/0147796 A1 * 5/2014 Wiles ..... F23Q 7/04 431/344
2015/0121890 A1 * 5/2015 Colannino ..... F23R 3/36 431/2
2017/0074510 A1 * 3/2017 Yang ..... F23D 14/28

FOREIGN PATENT DOCUMENTS

EP 1538418 A1 * 6/2005 ..... A63J 5/023
GB 572636 A * 10/1945
GB 2012926 A * 8/1979 ..... F41H 9/02
GB 2332021 A * 6/1999 ..... H01T 13/39
WO WO-9222364 A1 * 12/1992 ..... F41B 9/0031
WO WO-2004098717 A2 * 11/2004 ..... F41B 9/0031

* cited by examiner

SPARK IGNITION FLAMETHROWER

CROSS-REFERENCE TO RELATED APPLICATIONS

This application claims the benefit of U.S. Provisional Pat. App. No. 62/969,023 titled Spark Ignition System for a Flame Thrower, the disclosure of which is hereby incorporated by reference.

FIELD

This application relates to flamethrowers and more particularly to a flamethrower with a plasma-generating spark ignition system.

BACKGROUND

Existing flamethrowers use torch ignition systems and are often composed of heavy metal parts making them cumbersome and costly. A typical torch ignition uses a pilot flame that often requires a secondary fuel source for the pilot flame. Then, the fuel from the primary fuel source is passed across the pilot flame. One risk with multiple fuel sources is that heat from either the pilot flame or from the full flame once ignited can cause one of the fuel sources to explode if there is not proper insulation between parts.

Existing flamethrowers are often composed of heavy, cumbersome metal parts because of the heat emitted from both the pilot flame and the ignited flame. What is needed is a cost-effective flamethrower with a lightweight construction and a safer and more efficient ignition system. The Spark Ignition Flamethrower provides a flamethrower that can be construct with composite plastics or polymers and a spark or plasma to ignite the flame.

SUMMARY

In one embodiment, a composite flamethrower with a plasma ignition system includes a nozzle located on a first end of the composite flamethrower; a heat shield secured on the first end of the composite flamethrower around the nozzle; a fuel manifold coupled to the composite flamethrower configured to receive fuel from a fuel source; a fuel pump couple to the composite flamethrower configured to receive the fuel from the fuel manifold and conduct the fuel to the nozzle, which is configured to eject the fuel; a plasma-generating electrode configured to produce a plasma to ignite the fuel as the fuel exits the nozzle.

The composite flamethrower may further comprise a power coil and a control module; wherein the control module is configured to activate the fuel pump and the power coil thereby powering the plasma-generating electrodes to create the plasma. When fuel encounters the plasma the fuel ignites and a flame emits from the flamethrower.

In one embodiment, the composite flamethrower includes a nozzle insulator affixed to the first end of the composite flamethrower; and the plasma-generating electrode, the power coil, and the nozzle are mounted to the nozzle insulator.

In some embodiments, the composite flamethrower the plasma-generating electrode is nickel-chromium coated electrode or a copper electrode with a nickel-chromium coating.

In some embodiments, the nickel-chromium coated electrodes are mounted in a ceramic insulator.

In one embodiment, the composite flamethrower includes a top grip affixed to the composite flamethrower and a fuel tank removably connected to the fuel manifold. In this embodiment, the fuel tank is configured to supply fuel to the fuel manifold and to the fuel pump by force of gravity.

In one embodiment, the composite flamethrower includes a drop grip affixed to the composite flamethrower and a fuel tank removably attached to the fuel manifold. In this embodiment, a siphon tube is configured to draw the fuel into the fuel manifold.

In one embodiment, the composite flamethrower includes a hose adapter configured to connect the fuel manifold to the fuel source. The fuel source may be a detached fuel source such as a backpack tank.

In one exemplary embodiment, a composite flamethrower with a plasma ignition system includes a fuel manifold coupled to the composite flamethrower; a fuel pump; a fuel source; a grip having a trigger located on a first end of the composite flamethrower; a nozzle insulator located on a second end of the composite flamethrower; a nozzle coupled to the nozzle insulator; a spark electrode coupled to the nozzle insulator; a high voltage coil coupled to the nozzle insulator and configured to activate the spark electrode; and a control module configured to activate the fuel pump and the high voltage coil; wherein the fuel manifold is configured to supply fuel from the fuel source to the fuel pump and the fuel pump is configured to conduct the fuel to the nozzle which passes the fuel across the spark electrode thereby producing a flame.

In some embodiments, the composite flamethrower with a plasma ignition system includes a heat shield coupled to the second end of the composite flamethrower to protect internal components from excess heat. The heat shield may be comprised of a collar and a mica sheet wherein the mica sheet is located on the nozzle insulator and a tip of the nozzle and a tip of the spark electrode extend through the mica sheet.

In some embodiments, the spark electrode is comprised of two nickel-chromium coated electrodes mounted in the ceramic insulator.

In some embodiments, a distance between tips of the two nickel-chromium coated electrodes is between 2 mm to 10 mm.

In one exemplary embodiment, a composite flamethrower comprises a plasma-generating electrode configured to generate a plasma; and a nozzle configured to release fuel into the plasma generated by the plasma-generating electrode thereby producing a flame.

In one embodiment, a fuel manifold is coupled to the composite flamethrower; a fuel source is connected to the fuel manifold; and a fuel pump is within the composite flamethrower; wherein the fuel pump conducts the fuel from the fuel manifold to the nozzle.

In some embodiments, the composite flamethrower includes a high voltage coil that steps up a low voltage supplied by a battery to a high enough voltage to produce a plasma.

In some embodiments, a control module is in electric communication with the high voltage coil, the trigger, and the fuel pump. In response to the trigger, the control module may be configured to activate the fuel pump and the high-voltage coil which produces the plasma at the plasma-generating electrode.

In some embodiments, the electric potential across the plasma-generating electrodes is at least 375 kV.

DETAILED DESCRIPTION

Figure 1:
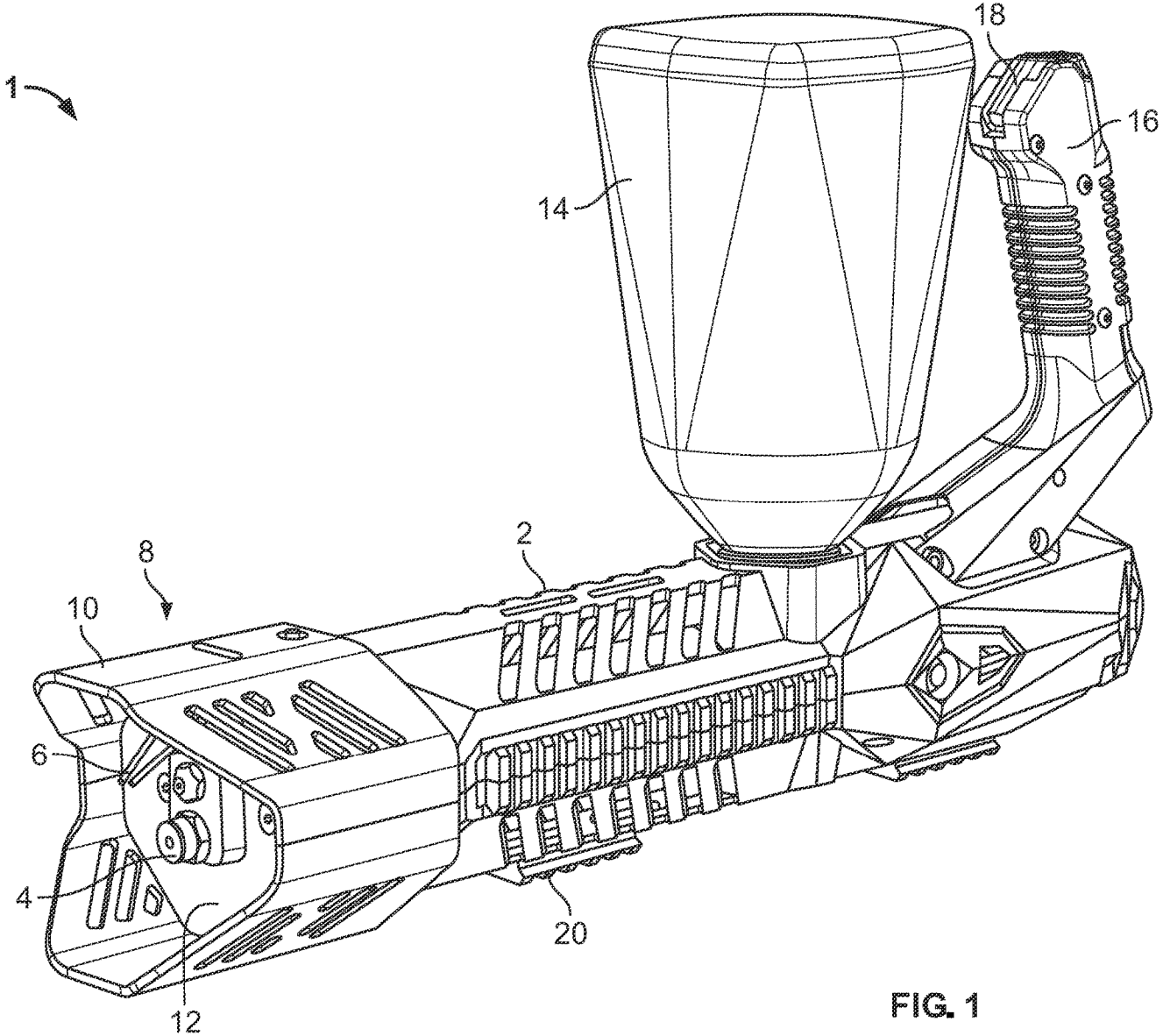
FIG. 1 illustrates a first embodiment of a Spark Ignition Flamethrower according to the present disclosure.

Referring to FIG. 1, a Spark Ignition Flamethrower 1 according to the present disclosure is shown. In one exemplary embodiment, the Spark Ignition Flamethrower 1 includes a housing 2, a nozzle 4, an electrode 6, and a heat shield assembly 8. The housing 2 may be made of a composite, polymer, plastic, or metal, but is not limited thereto. However, a composite housing made from a suitable polymer or plastic will weigh less and be easier to handle. The housing 2 contains the internal components, which are discussed in subsequent figures. The nozzle 4 is configured to emit a fuel across the electrodes 6. The heat shield assembly 8 is configured to protect the internal components and the housing 2 from excessive heat from the flame, especially in embodiments where the housing 2 is a composite.

In some embodiments, the heat shield assembly 8 includes a collar 10 and a sheet 12. The heat shield assembly 8 may be comprised of a suitable heat and flame resistant material, such as metal or plastic. In one exemplary embodiment, the heat shield assembly 8 may be aluminum while the housing 2 is comprised of a polymer composite. The sheet 12 may be a mica sheet or any other suitable heat and flame resistant material. In some embodiments, the nozzle 4 and electrodes 6 may extend partially through the heat shield assembly 8. In such embodiments, only a small portion of the nozzle 4 and the electrodes 6 are exposed to the heat from the flame.

In some embodiments, the Spark Ignition Flamethrower 1 includes an attachment means 20 for attaching the Flamethrower 1 to another weapon, such as a rifle. In one embodiment, the attachment means 20 may be a Picatinny rail as is commonly used in military weaponry.

Figure 2:
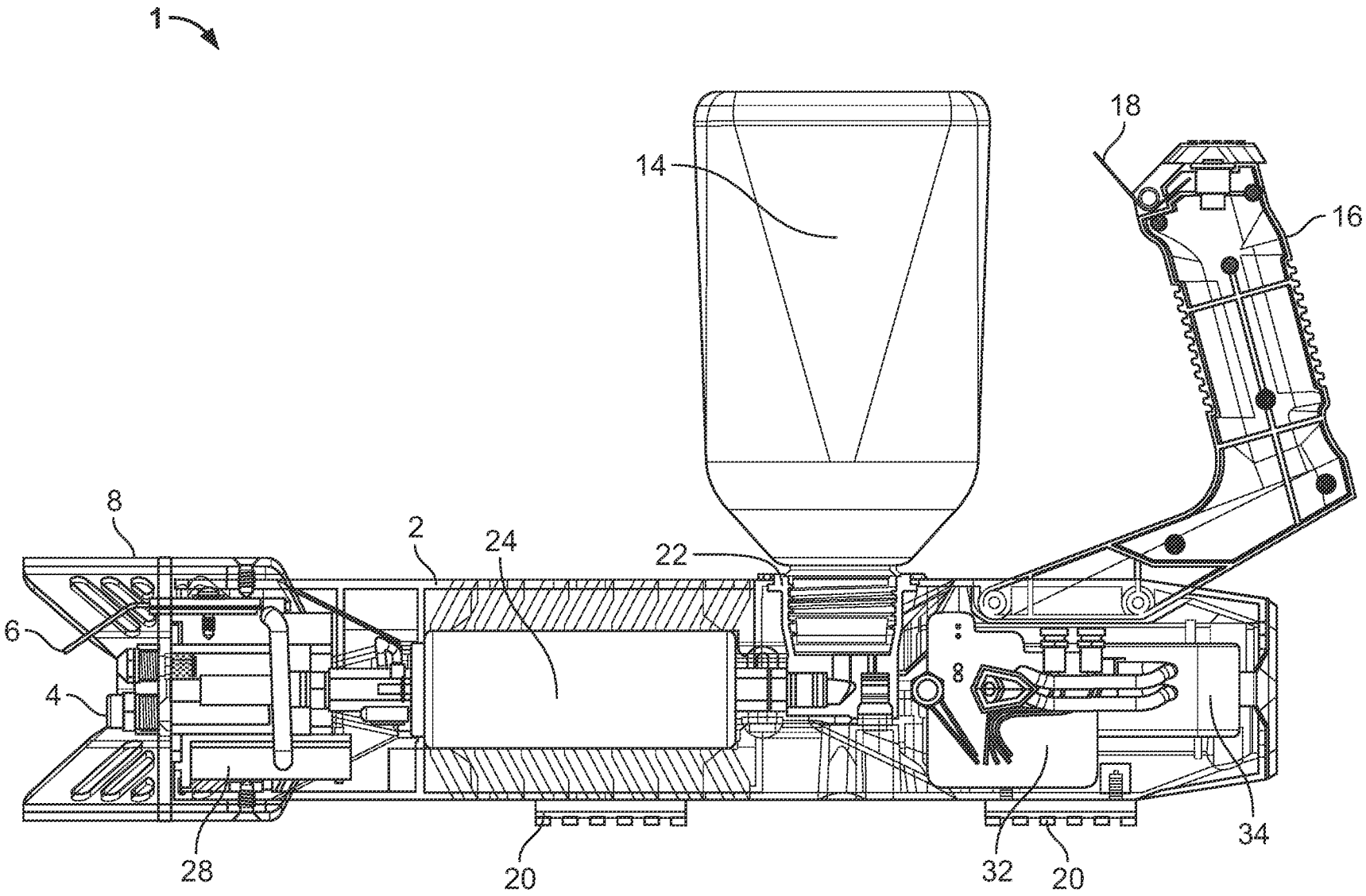
FIG. 2 is a cross-section view thereof.

Referring to FIG. 2, a cross-sectional view of the Spark Ignition Flamethrower 1 shows the internal components. In one exemplary embodiment, the Spark Ignition Flamethrower 1 includes the housing 2, a nozzle 4, an electrode 6, a heat shield assembly 8, a fuel tank 14, a handle or grip 16, a trigger 18, a fuel manifold 22, a fuel pump 24, a high voltage coil 28, a control module 32, and a power source 34. The fuel manifold 22 may be configured to connect to a fuel tank 14. The power source 34 may be a rechargeable battery. In one exemplary embodiment, the control module 32 may be a simple circuit or control board that electronically connects to the trigger 18 and to the fuel pump 24 and the electrode 6; when a user engages the trigger 18, the control module 32 activates the fuel pump 24 and the electrode 6.

The embodiment shown in FIG. 2 has the handle 16 in a top grip position. In top grip embodiments, the fuel tank 14 is attached to the fuel manifold 22 upside-down. In this embodiment, the fuel in the fuel tank 14 moves into the fuel manifold 22 via gravity. The trigger 18 may be configured to activate the fuel pump 24, the high voltage coil 28, and the electrode 6 via the control module 32. The fuel manifold 22 then conducts the fuel to the fuel pump 24; the fuel pump 24 transmits the fuel to the nozzle 4; and the fuel is expelled across the electrode 6 thereby igniting to produce the flame.

Figure 3:
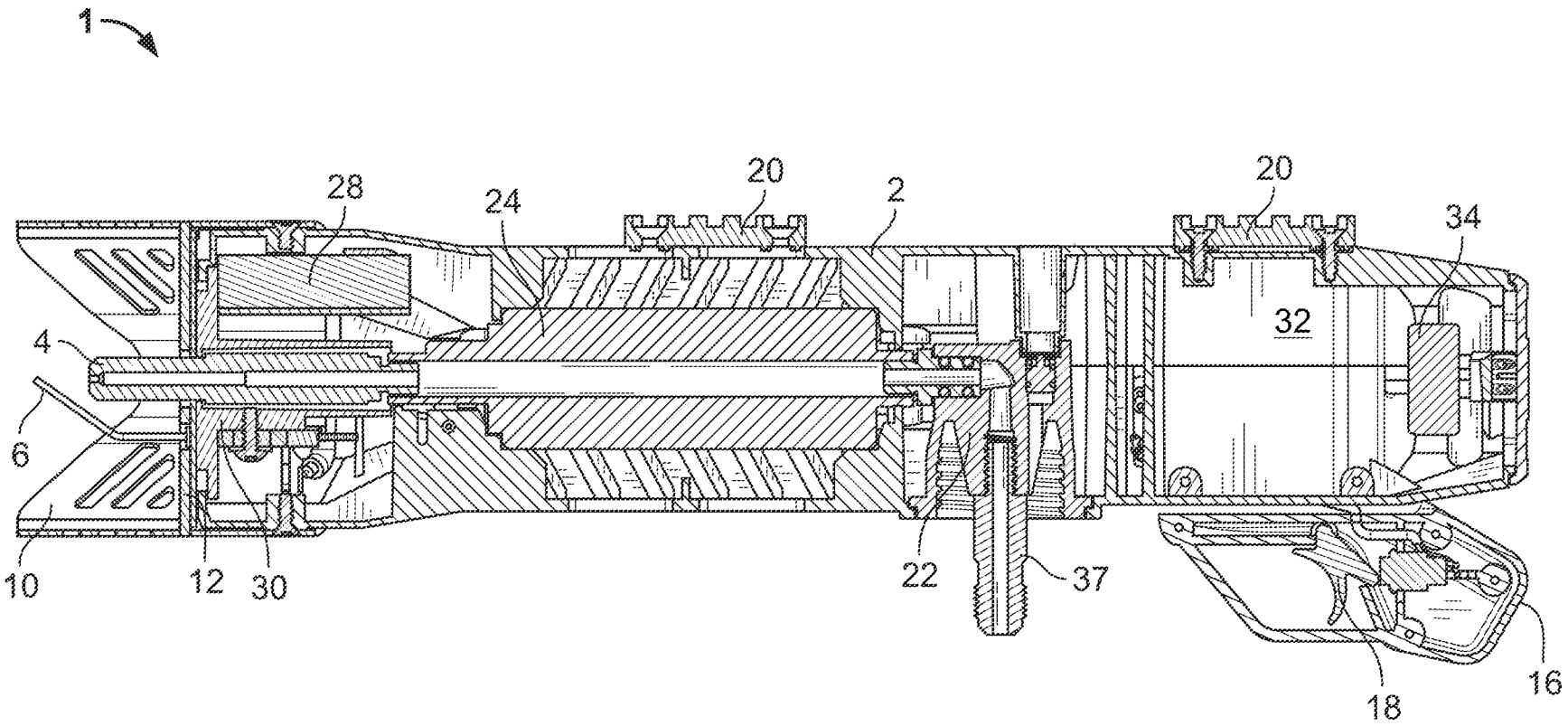
FIG. 3 is a cross-section view of a second embodiment of the Spark Ignition Flamethrower.

Referring to FIG. 3, another embodiment of the Spark Ignition Flamethrower 1 is shown configured to receive fuel from a detached source (not shown). In this exemplary embodiment, the Flamethrower 1 includes the housing 2, nozzle 4, spark electrodes 6, heat shield collar 10, heat shield sheet 12, the handle 16 with trigger 18, Picatinny rails 20, fuel manifold 22, fuel pump 24, power coil 28, control module 32, and battery 34. In this embodiment, the nozzle 4 and power coil 28 are mounted onto the nozzle insulator 30; the handle 16 is in a drop grip position on the bottom of the housing 2; and the fuel manifold 22 includes a hose adapter 37 which is configured to connect to a hose (not shown) to draw fuel into the fuel manifold 22 from a detached source, such as a backpack tank.

Figure 4:
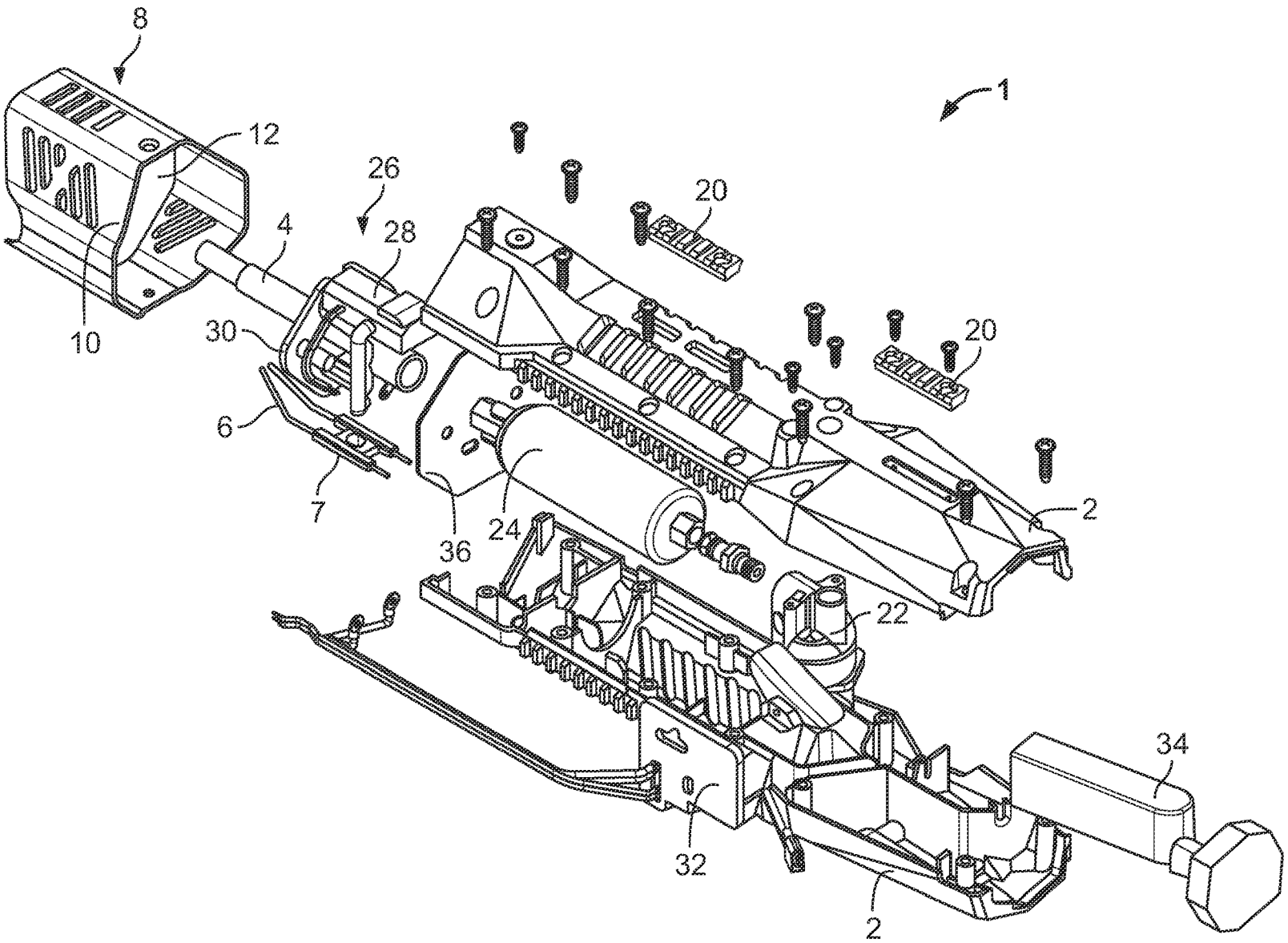
FIG. 4 is an exploded view thereof.

Referring to FIG. 4, an exploded view of another exemplary embodiment of the Spark Ignition Flamethrower 1 in drop grip position is shown with the handle 16 removed. In some embodiments, the Spark Ignition Flamethrower 1 includes a nozzle/electrode assembly 26. In some embodiments, the housing 2 may include a second heat shield 36 between the fuel pump 24 and the nozzle/electrode assembly 26. The second heat shield 36 may be may be made of any suitable heat dampening material. In one exemplary embodiment, the second heat shield 36 and the heat shield sheet 12 are pressed mica.

Figure 5:
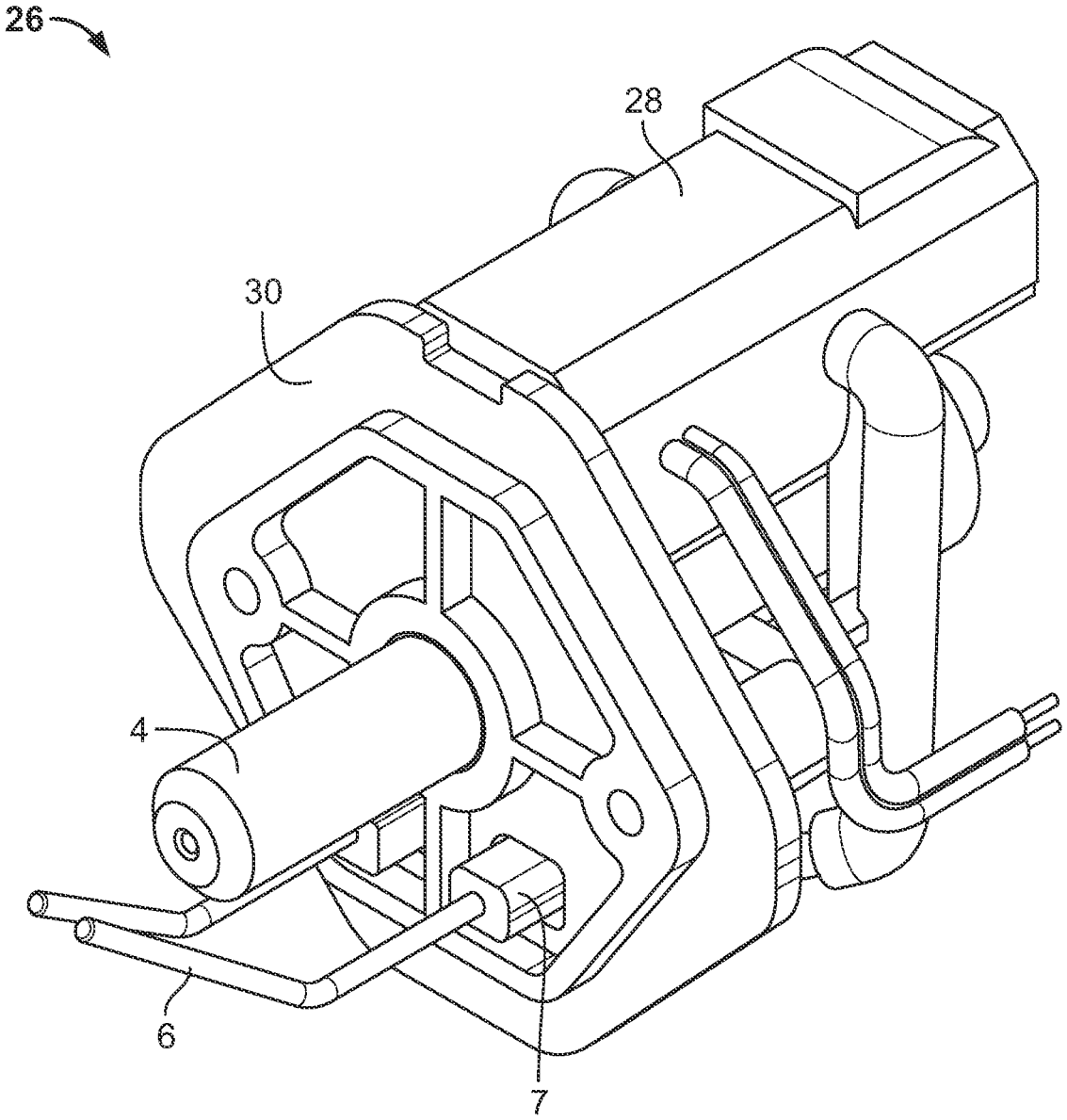
FIG. 5 illustrates an exemplary embodiment of a nozzle assembly according to the present disclosure.

FIG. 5 illustrates the nozzle/electrode assembly 26. The nozzle/electrode assembly 26 may include a nozzle insulator 30 onto which the nozzle 4, the electrodes 6, and the power coil 28 are mounted.

Referring now to FIGS. 4 and 5, in some embodiments, the electrodes 6 are nickel-chromium electrodes mounted in a ceramic insulator 7.

Figure 6:
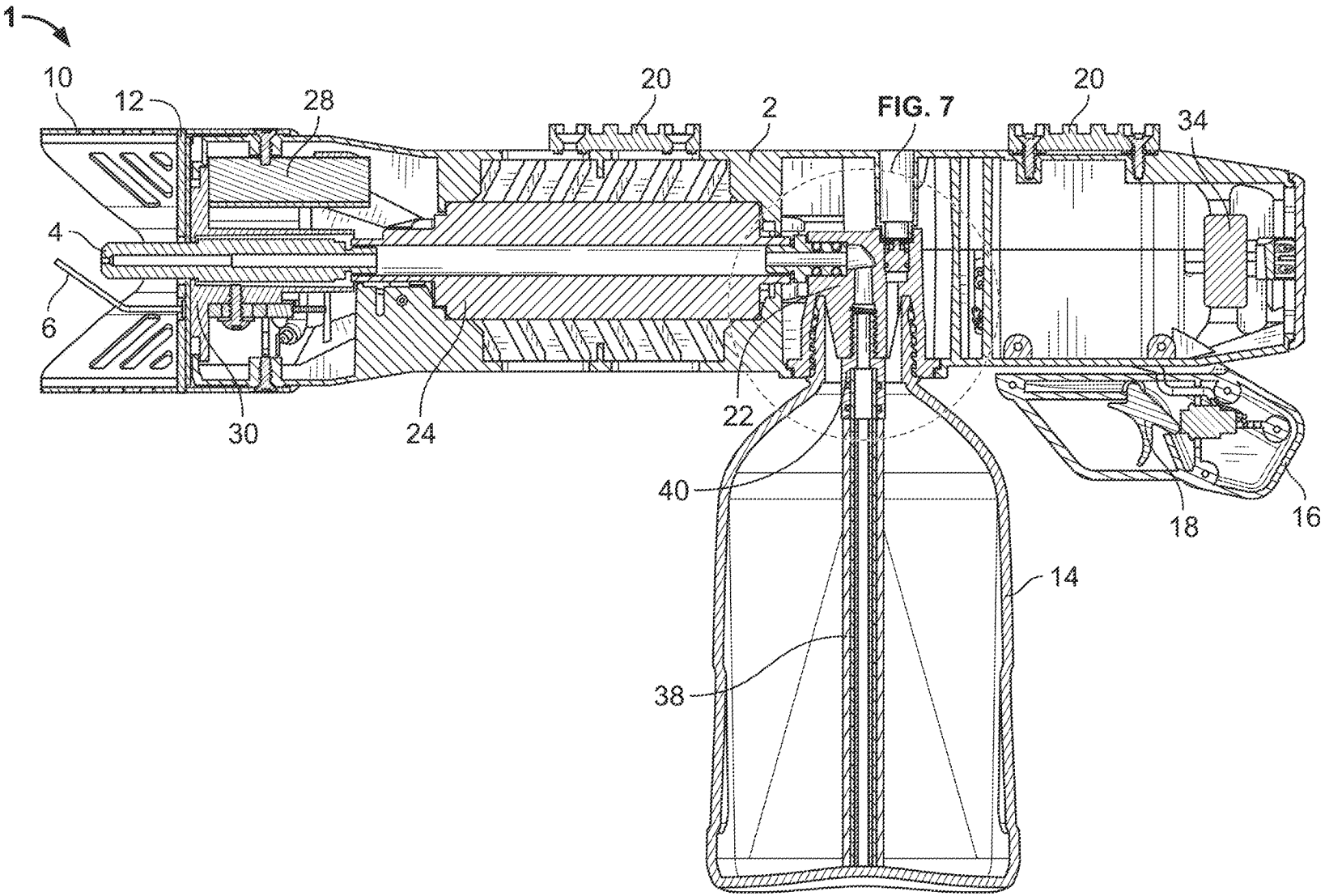
FIG. 6 is a cross-section view of a third embodiment of the Spark Ignition Flamethrower.

Referring to FIG. 6, another embodiment of the Spark Ignition Flamethrower 1 is shown. In this exemplary embodiment, the Spark Ignition Flamethrower 1 is configured to draw fuel out of the fuel tank 14 via a siphon tube 38. The siphon tube 38 is attached to the fuel manifold 22 via a siphon tube adapter 40.

Figure 7:
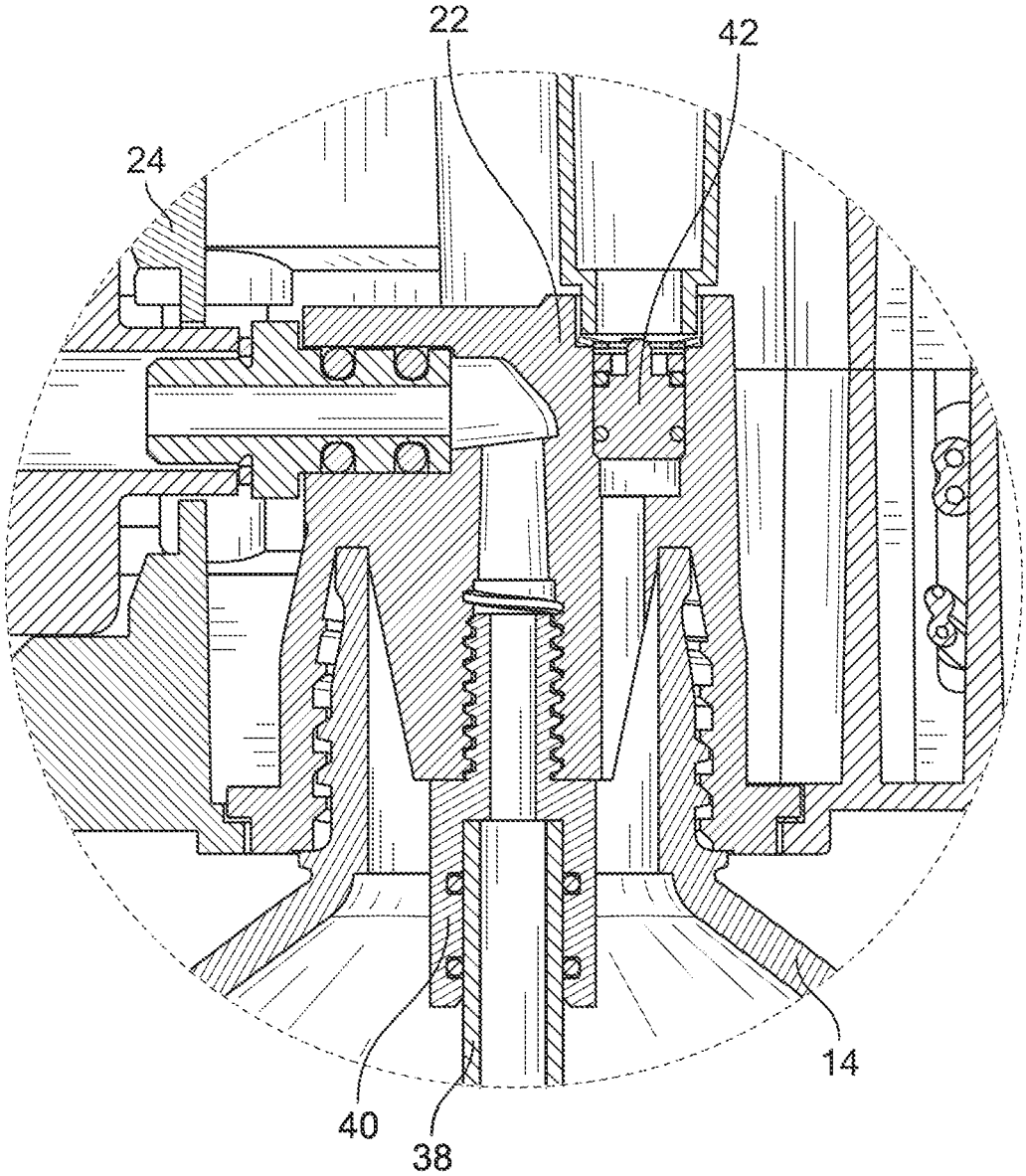
FIG. 7 is a close-up, cross-section view of the fuel manifold according to the present disclosure.

Referring to FIG. 7, a close-up, cross-section view of the dotted area in FIG. 6 can be seen. FIG. 7 shows a portion of fuel tank 14, fuel manifold 22, fuel pump 24, siphon tube 38, tube adapter 40 and check valve 42. Check valve 42 vents air into fuel tank 14 to displace the fuel being removed. Where check valve 42 meets the body of fuel tank 14 there is a seal which separates the air path so it is completely outside the housings. Check valve 42 is mounted offset just enough to fit within the fuel tank 14 without interfering with the seal where the fuel tank 14 meets the fuel manifold 22. Check valve 42 also does not interfere with the area required to mount a backpack tank or dip tube (siphon) which is concentric with all other inputs.

In one embodiment, the electrode 6 is a spark electrode. Spark ignition uses a spark or arc between two electrodes. When the fuel encounters the spark, the fuel ignites to produce the flame.

In one embodiment, the electrode 6 is a plasma-generating electrode. The plasma-generating electrodes 6 impart significantly more energy in the creation of the arc between the electrodes. Generally, the ionization process of gas by high voltage takes several steps, as follows. First, the power coil 28 generates a high voltage across the electrodes 6 and there is an air gap between the electrodes. When the voltage first comes on, it "looks" for any randomly-occurring ionization event within the gap, as would happen if for example an ultraviolet photon happened to hit the surface of one of the electrodes at that time, or if that photon hit a gas molecule just right and temporarily dislodged one of its electrons within the air space in the gap. The voltage then accelerates the loose electron towards the (+) electrode and any positive ion towards the (−) electrode before they have the opportunity to recombine. They pick up energy from the field and speed up enough that if they happen to collide with another gas molecule on the way, it too gets ionized and the charged particles join in and get accelerated too. Soon you have an avalanche of ions approaching the electrodes and the air between them is rapidly becoming electrically conducting as it gets populated with ions. Then, when one of the positive ions smacks into the negative electrode, it busts loose a bunch of electrons which zoom off toward the positive electrode and very quickly the air gap's resistance falls to almost nothing and if there is no external resistance to limit the current, a huge current develops between the electrodes and since the current is huge and the air gap is still a (small) resistor, ohmic heating then raises the temperature of the ionized gas to incandescence and you have a power arc consisting of an extremely hot plasma.

The plasma improves the likelihood of ignition of the fuel over the spark because a plasma-generating electrode 6 produces a plasma or corona region that can ignite the fuel. In the spark ignition, the fuel must encounter the spark itself but in the plasma-generating embodiments, there is a plasma or corona region around the electrodes 6 which is a larger area capable of igniting the fuel.

In one embodiment, the power coil 28 is an induction coil and the electrode 6 is a plasma-generating electrode. The power coil 28 receives low voltage power from the battery 34 and steps up to a high voltage. The high voltage across the electrodes 6 generates a plasma by ionizing the gas in the atmosphere between the electrode tips. By way of example, a pulse frequency of at least 20 kHz may be used to produce the plasma. In one exemplary embodiment, the power coil 28 runs on 6 V input and outputs 375 kV with max output of 0.5 A.

In some exemplary embodiments, the tips of the spark electrodes 6 are placed between 10-15 mm from the tip of the nozzle 4. The distance between the tips of the spark electrodes 6 may be from 2-10 mm.

In one exemplary embodiment, the spark electrodes 6 are made of Nickel-Chromium Alloy. For example, an Ni80Cr20 alloy is 80% Nickel by weight and 20% Chromium by weight. Nickel-Chromium may be used over copper, aluminum, or steel because its resistance increases less when hot. Increased resistance causes more strain on upstream electrical components like the high power coil 28, and solid state switching.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the embodiments described herein are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A composite flamethrower with a plasma ignition system, the composite flamethrower having a handle that is configured to be used in both a top grip and a bottom grip configuration upon rotation of the flamethrower, the flamethrower comprising:

a housing having a first end and a second end;

a nozzle located on the first end of the housing;

a heat shield secured on the first end of the housing around the nozzle;

a fuel manifold having a check valve/air vent, the fuel manifold in direct contact with a fuel source containing fuel, the fuel manifold adaptable to couple with and to receive fuel from multiple different types of fuel sources in both the top grip configuration when the handle extends above the housing, and the bottom grip configuration, when upon rotation of the housing, the same handle extends below the housing, and deliver the fuel directly to the nozzle, the check valve/air vent allowing air to enter the fuel source as fuel is consumed;

a fuel pump situated between the nozzle and the fuel manifold and configured to receive the fuel from the fuel manifold and conduct the fuel to the nozzle, which is configured to eject the fuel; and a plasma-generating electrode configured to produce a plasma to ignite the fuel as the fuel exits the nozzle, wherein the fuel manifold further comprises a hose adapter, the fuel manifold is further adaptable in the top grip configuration to receive fuel from the fuel source via gravity, and when the housing is rotated, in the bottom grip configuration to receive fuel via a hose connected to the hose adapter which draws fuel from the fuel source.

2. The composite flamethrower with a plasma ignition system of claim 1, further comprising:

a power coil and a control circuit; and the control circuit configured to activate the fuel pump and the power coil thereby powering the plasma-generating electrode to create the plasma, passing the fuel to the plasma, and igniting a flame that emits from the composite flamethrower.

3. The composite flamethrower with a plasma ignition system of claim 2, further comprising:

a nozzle insulator affixed to the first end of the housing; wherein the plasma-generating electrode, the power coil, and the nozzle are mounted to the nozzle insulator.

4. The composite flamethrower with a plasma ignition system of claim 1, wherein the plasma-generating electrode is a nickel-chromium coated electrode.

5. The composite flamethrower with a plasma ignition system of claim 4, further comprising a ceramic insulator;

wherein the nickel-chromium coated electrode is mounted in the ceramic insulator.

6. The composite flamethrower with a plasma ignition system of claim 1, further comprising:

a siphon tube configured to draw the fuel into the fuel manifold when the flamethrower is in the bottom grip configuration.

7. A composite flamethrower with a plasma ignition system, the composite flamethrower having a handle that is configured to be used in both a top grip and a bottom grip configuration upon rotation of the flamethrower, the flamethrower comprising:

a fuel manifold having a check valve/air vent, the fuel manifold in direct contact with a fuel source containing fuel, the fuel manifold adaptable to couple with and to receive fuel from multiple different types of fuel sources in both the top grip configuration when the handle extends above the housing, and the bottom grip configuration, when upon rotation of the housing, the same handle extends below the housing, and deliver the fuel directly to the nozzle, the check valve/air vent allowing air to enter the fuel source as fuel is consumed;

a fuel pump situated between the nozzle and the fuel manifold and configured to receive the fuel from the fuel manifold and conduct the fuel to the nozzle, which is configured to eject the fuel;

a trigger located on the handle on a first end of the composite flamethrower;

a nozzle insulator located on a second end of the composite flamethrower;

a nozzle coupled to the nozzle insulator;

a spark electrode coupled to the nozzle insulator;

a high voltage coil coupled to the nozzle insulator and configured to activate the spark electrode; and a control circuit configured to activate the fuel pump and the high voltage coil; wherein the fuel manifold configured to supply fuel from the fuel source to the fuel pump and the fuel pump is configured to conduct the fuel to the nozzle which passes the fuel across the spark electrode thereby producing a flame, wherein the fuel manifold further comprises a hose adapter, the fuel manifold is further adaptable in the top grip configuration to receive fuel from the fuel source via gravity, and when the housing is rotated, in the bottom grip configuration to receive fuel via a hose connected to the hose adapter which draws fuel from the fuel source.

8. The composite flamethrower with a plasma ignition system of claim 7, further comprising:

a heat shield coupled to the second end of the composite flamethrower, the heat shield having a collar and a mica sheet;

wherein the mica sheet is located on the nozzle insulator and a tip of the nozzle and a tip of the spark electrode extend through the mica sheet.

9. The composite flamethrower with a plasma ignition system of claim 7, wherein the spark electrode further comprises:

two nickel-chromium coated electrodes; and a ceramic insulator;

the two nickel-chromium coated electrodes mounted in the ceramic insulator.

10. The composite flamethrower with a plasma ignition system of claim 9, further comprising a distance between tips of the two nickel-chromium coated electrodes is between 2 mm to 10 mm.

11. The composite flamethrower with a plasma ignition system of claim 7, further comprising:

a siphon tube configured to draw the fuel into the fuel manifold when the flamethrower is in the bottom grip configuration.

12. A composite flamethrower having a handle that is configured to be used in both a top grip and a bottom grip configuration upon rotation of the flamethrower, the flamethrower comprising:

a housing having a first end and a second end;

a plasma-generating electrode configured to generate a plasma;

a nozzle configured to release fuel into the plasma generated by the plasma-generating electrode thereby producing a flame;

a fuel manifold having a check valve/air vent, the fuel manifold in direct contact with a fuel source containing fuel, the fuel manifold adaptable to couple with and to receive fuel from multiple different types of fuel sources in both the top grip configuration when the handle extends above the housing, and the bottom grip configuration, when upon rotation of the housing, the same handle extends below the housing, and deliver the fuel directly to the nozzle, the check valve/air vent allowing air to enter the fuel source as fuel is consumed; and a fuel pump situated between the nozzle and the fuel manifold, wherein the fuel pump is configured to conduct the fuel from the fuel manifold to the nozzle, wherein the fuel manifold is further adaptable in the top grip configuration to receive fuel from the fuel source via gravity, and when the housing is rotated, in the drop grip configuration to receive fuel via a hose connected to a hose adapter which draws fuel from the fuel source.

13. The composite flamethrower of claim 12, further comprising:

a high voltage coil situated proximate the plasma-generating electrode; and a control circuit;

wherein the control circuit is configured to activate the fuel pump and the high-voltage coil which produces the plasma at the plasma-generating electrode.

14. The composite flamethrower of claim 13, the high voltage coil supplying at least 375 kV to the plasma-generating electrodes.

15. The composite flamethrower of claim 12, wherein the plasma-generating electrode is located on the second end of the housing and positioned in front of the nozzle.

* * * * *